US012584318B2

(12) United States Patent
Simonin

(10) Patent No.: US 12,584,318 B2
(45) Date of Patent: Mar. 24, 2026

(54) TEMPLATE

(71) Applicant: Illinois Tool Works Inc., Glenview, IL (US)

(72) Inventor: Jean-Luc Simonin, Bourg lès Valence (FR)

(73) Assignee: Illinois Tool Works Inc., Glenview, IL (US)

( * ) Notice: Subject to any disclaimer, the term of this patent is extended or adjusted under 35 U.S.C. 154(b) by 235 days.

(21) Appl. No.: 18/555,091

(22) PCT Filed: Apr. 22, 2022

(86) PCT No.: PCT/US2022/025917
§ 371 (c)(1),
(2) Date: Oct. 12, 2023

(87) PCT Pub. No.: WO2022/231965
PCT Pub. Date: Nov. 3, 2022

(65) Prior Publication Data

US 2024/0200339 A1 Jun. 20, 2024

(30) Foreign Application Priority Data

| | | |
|---|---|---|
| Apr. 26, 2021 | (EP) | 21170551 |
| Jun. 28, 2021 | (EP) | 21182205 |
| Mar. 9, 2022 | (FR) | 2202069 |

(51) Int. Cl.

| | |
|---|---|
| ***E04F 13/08*** | (2006.01) |
| ***E04F 21/18*** | (2006.01) |
| *E04G 21/18* | (2006.01) |

(52) U.S. Cl.
CPC ..... *E04F 13/0803* (2013.01); *E04F 21/1855* (2013.01); *E04G 21/1841* (2013.01)

(58) Field of Classification Search
CPC ..... E04F 13/0803; E04F 21/1855; E04G 21/1841
USPC ..... 33/646, 406
See application file for complete search history.

(56) References Cited

U.S. PATENT DOCUMENTS

| | | | | |
|---|---|---|---|---|
| 358,699 A * | 3/1887 | Scott | B25H 7/04 | 33/646 |
| 378,548 A * | 2/1888 | Hotchkiss | E04F 21/1855 | 33/646 |
| 473,098 A * | 4/1892 | Underwood | E04F 21/1855 | 33/646 |

(Continued)

FOREIGN PATENT DOCUMENTS

WO 2008003975 A1 1/2008

OTHER PUBLICATIONS

French Search Report from French Application No. 2202069, mailed on Feb. 14, 2025 (7 pages).

(Continued)

*Primary Examiner* — Brent W Herring
(74) *Attorney, Agent, or Firm* — Neal, Gerber & Eisenberg LLP

(57) ABSTRACT

The present disclosure relates to a template to guide the user when securing at least one cladding board on a brace lath, said template comprising at least one orifice for guiding at least one element for securing of the cladding board on the brace lath, at least one of said guide orifices being movable in the template.

16 Claims, 12 Drawing Sheets

(56) References Cited

U.S. PATENT DOCUMENTS

| | | | | | |
|---|---|---|---|---|---|
| 694,023 | A | * | 2/1902 | Nelson | E04F 21/1855 33/646 |
| 774,114 | A | * | 11/1904 | Spear | B25H 7/04 33/646 |
| 1,598,986 | A | | 9/1926 | Clifford | |
| 2,952,915 | A | * | 9/1960 | Schrauder | E04G 21/1816 33/406 |
| 4,654,975 | A | * | 4/1987 | Lopez | B25C 7/00 33/646 |
| 4,904,111 | A | * | 2/1990 | Weisbach | E04F 15/14 249/9 |
| 5,228,667 | A | * | 7/1993 | Bridegum | E04D 13/158 269/45 |
| 6,170,214 | B1 | | 1/2001 | Treister et al. | |
| 8,931,225 | B2 | | 1/2015 | Fifield et al. | |
| 2008/0209749 | A1 | | 9/2008 | Chua | |
| 2023/0228098 | A1 | | 7/2023 | Coyle et al. | |

OTHER PUBLICATIONS

International Search Report and Written Opinion from International Application No. PCT/US2022/025917, mailed Aug. 11, 2022 (13 pages).

* cited by examiner

TEMPLATE

PRIORITY CLAIM

This application is a national stage application of PCT/US2022/025917, filed on Apr. 22, 2022, which claims priority to and the benefit of European Patent Application No. 21170551.2, which was filed on Apr. 26, 2021, European Patent Application No. 21182205.1, which was filed on Jun. 28, 2021 and French Patent Application No. 2202069, which was filed on Mar. 9, 2022, the entire contents of each of which are incorporated herein by reference.

TECHNICAL FIELD

The present disclosure generally relates to templates, and in particular templates for laying of exterior cladding. More specifically, although not exclusively, this present disclosure relates to a template that makes it possible to guide the user when securing at least one exterior cladding board on a brace lath, such as, for example, a building cladding panel.

TECHNICAL BACKGROUND

Increasingly, buildings are being covered with exterior cladding known as cladding panels. A first reason for installing a cladding panel on a building is the addition of a supplementary protective layer on the structure. In fact, the cladding panel increases the mechanical strength of any building and its resistance to cracks caused by temperature or climate variations, by absorption of water, by the sun, and by any type of pollution. The cladding panel also provides additional protection against humidity, rain, mold, and strong winds.

The aesthetic appeal which certain types of cladding panel provide is a second reason that justifies the supplementary cost associated with the addition of a cladding. The materials commonly used for the cladding panel include wood, metal and plastics or composite materials.

Conventionally, to create the cladding panel with wooden slats on a building, in addition to any sealing sheets and anti-rodent grids, it is necessary to install previously on the exterior surfaces of the building a network of wooden brace laths that will support the cladding panel slats. Once the network of brace laths has been installed, the cladding panel slats remain to be secured on the brace laths.

Standard DTU 41.2 for exterior wooden cladding indicates the rules to be followed to ensure satisfactory implementation of laying of cladding panels. In particular, it imposes the positioning and number of points of securing of the cladding panel slats on the brace laths, according to the thickness of the slats for example. In fact, for slats smaller than 125 mm, a single securing point is necessary, and consequently the securing points are concealed. For slats bigger than that size, two securing points must be provided, which makes them visible.

Conventionally, cladding panel installers attempt to optimise the appearance of the cladding panel for example by aligning the securing points. For this purpose, they conventionally use templates that guide them when they are installing the securing elements such as nails or screws.

A template according to the prior art is typically a piece of wood that is configured specifically for given dimensions of brace laths and for constraints in terms of the number of securing points and spacing between given securing points. Thus, a template of this type is specific for a site or a building, and cannot be reused for another site or building (which would have different constraints). This requires the cladding panel installers to configure and produce templates for each new site, which is costly, it takes time, and makes the intervention complex.

It would therefore be advantageous to provide a template to guide the user during the securing of at least one cladding board on a brace lath, which template attenuates the problems with the known systems.

SUMMARY

On the basis of the aforementioned problems, the present disclosure relates to a template to guide the user when securing at least one cladding board on a brace lath, said template comprising at least one orifice for guiding at least one element for securing of the cladding board on the brace lath, characterized in that at least one of said guide orifices is configured to be movable in the template.

It will be appreciated that the cladding boards can be constituted by any type of material, and in particular, but not exclusively, by woods, metals, plastics (e.g., PVC) and composite materials. The securing element(s) can for example be nails, screws, dowels, or any other securing element. For example, nails can be used and put into place by way of nail drivers through the guide orifice(s).

According to an advantageous embodiment of the present disclosure, the template comprises two guide orifices. It will be appreciated that the template can comprise any number of guide orifices.

According to an advantageous embodiment of the present disclosure, each guide orifice is configured to be movable in the template.

According to another embodiment of the present disclosure, one or a plurality of guide orifices is/are fixed in the template, whereas one or a plurality of other orifices is/are movable in the template.

According to an embodiment of the present disclosure, the template comprises a first branch that is configured to be substantially aligned with the brace lath, and at least one of the guide orifices is/are movable in translation along the first branch.

Advantageously, the first branch and at least one guide orifice each comprise mechanism for guiding in translation that enable the guide orifice to translate along the first branch, or conversely.

According to an embodiment of the present disclosure, the template comprises a first opening that is substantially aligned with the brace lath, the mechanisms for guiding in translation of the first branch comprising at least one second opening that is configured to cooperate with the mechanism for guiding in translation of the guide orifice, such that, when the mechanism for guiding in translation of the first branch and of the guide orifice cooperate with one another, the guide orifice is situated facing the first opening of the template.

According to one embodiment, the template comprises a first opening that is substantially aligned with the brace lath, each mechanism for guiding in translation of the first branch and the guide orifice comprising at least two guide notches that are configured to cooperate with one another in order to permit the positioning of the guide orifice on the template, such that the guide orifice is situated facing the first opening of the template when the mechanism for guiding in translation of the first branch and of the guide orifice are cooperating with one another.

For example, at least one of the guide orifices is removable (it can for example be detached or removed from the template).

According to an advantageous embodiment of the present disclosure, the template comprises mechanisms for rendering integral with said brace lath.

According to an advantageous embodiment of the present disclosure, the template comprises a second branch that is substantially perpendicular to the first branch, said second branch comprising said mechanism for rendering integral with said brace lath.

According to an embodiment of the present disclosure, the mechanism for rendering integral comprise at least two stop elements, at least one of said stop elements being configured to be movable in translation along a portion of the second branch, such as to press the brace lath on both sides once the stop elements are positioned against the brace lath.

According to one embodiment, the second branch also comprises mechanisms for alignment of the template, each mechanism for alignment being configured to be in contact with a junction rim between two cladding boards that are assembled to one another.

According to one embodiment, the mechanisms for alignment of the template are fixed or movable relative to the second branch.

According to an advantageous embodiment of the present disclosure, each of the stop elements is configured to be movable in translation along portions of the second branch.

In order to avoid any doubt, all of the characteristics described here also apply to any aspect of the present disclosure.

Within the context of the present application, it is specifically intended for the different aspects, embodiments, examples and alternatives described in the preceding paragraphs, in the claims and/or in the description and in the following drawings, and in particular the individual characteristics thereof, to be able to be taken independently or in any combination. In other words, all the implementations and/or characteristics of any embodiment can be combined in any manner, unless these characteristics are incompatible.

In order to avoid any ambiguity, the terms "can", "and/or", "for example", and any other similar term used in the present document, must be interpreted as being non-limiting, such that any characteristic thus described need not necessarily be present. In fact, any combination of optional characteristics is specifically envisaged without departing from the scope of the present disclosure, whether or not these characteristics are specifically claimed. The applicant reserves the right to modify any claim originally filed, or to file any new claim accordingly, including the right to modify any claim originally filed so that it is dependent on, and/or incorporates any characteristic of any other claim, even though it has not originally been claimed in this manner.

LIST OF THE FIGURES

Embodiments of the present disclosure will now be described purely by way of example, with reference to the appended drawings in which.

DETAILED DESCRIPTION

Different aspects of different embodiments of the present disclosure are described in greater detail below, with reference to the appended drawings.

Figure 1:
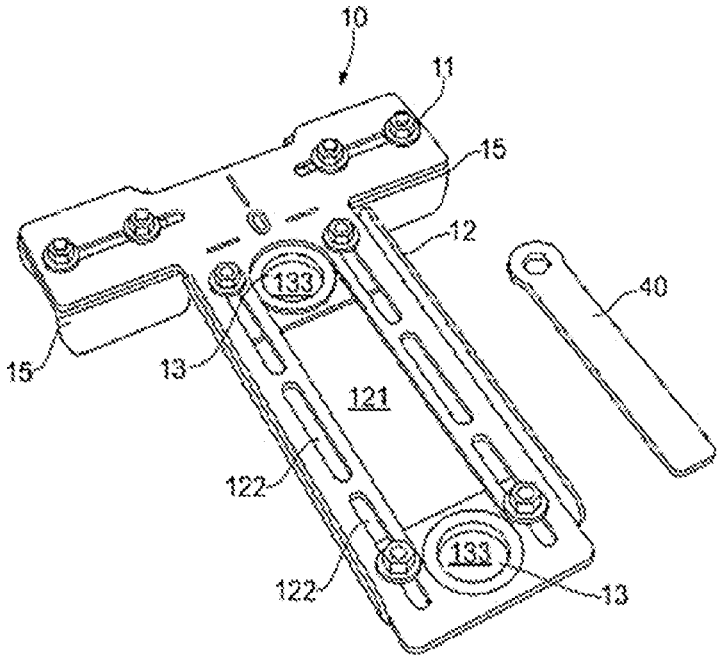
FIG. 1 is a schematic view of a template according to a first embodiment of the present disclosure.

With reference now to FIG. 1, a template 10 according to a first embodiment of the present disclosure is shown. The template 10 is for example made of metal or aluminum. It is however clear that the template can be made of any other material such as plastic, wood, composite materials, or also any other material.

The template 10 in FIG. 1 has for example a form in the shape of a "T" (any other form can be envisaged according to the present disclosure, for example a form in the shape of an "L" or an "I").

The template 10 comprises a first branch 12 that is configured to be substantially aligned with a brace lath 31 on which an operator must secure a cladding board 32. Advantageously, the first branch 12 comprises two guide orifices 13, and at least some or all of these guide orifices 13 are configured to be movable in translation along first branch 12.

Also, at least some or all of the guide orifices 13 are configured to be removable, as described hereinafter.

The first branch 12 comprises for example a recess 121 in its central part. In this case, each guide orifice 13 can be produced for example thanks to a rectangular part, the width of which is substantially identical to the width of the first branch 12.

Each guide orifice 13 comprises a recess 133 in the form of a disc in its center that forms the guide orifice.

When the guide orifice 13 is positioned on the first branch 12, it is placed facing the recess 121 of the first branch 12.

In the example in FIG. 1, the guide orifice 13 comprises two screwing heads 131 that are incorporated (for example by welding) in the rectangular body of the guide orifice, each screwing head being placed on both sides of the recess 133.

According to another embodiment, two holes are provided in the rectangular body of the guide orifice 13, they are situated on both sides of the recess 133, and, for example by way of screws and nuts, they make it possible to secure the guide orifice on the edges of the first branch 12, as described hereinafter.

In order to carry out fitting of the guide orifice 13 on the branch 12, each screwing head 131 of the guide orifice is inserted in a corresponding opening 122 of the first branch 12. According to one embodiment, multiple openings 122 are situated on both sides of the recess 121. Then, the guide orifice 13 is secured by compression on the branch 12 by way of a nut 132 that is screwed onto the screw head. If the operator wishes to adjust the guide orifice, it is then sufficient for him to unscrew the nuts 132 (two in the example of FIG. 1), then to guide the guide orifice in translation along the branch 12 by sliding the screw heads 131 into the corresponding opening 122.

It should be noted that the opening 122 of the branch 12 can have a length that is substantially equal to the branch 12. For reasons of rigidity of the assembly, a plurality of openings 122 are provided along the branch 12. According to an advantageous embodiment, the template 10 comprises mechanisms for rendering integral with a brace lath (for example the brace lath 31 in FIG. 3). These mechanisms for rendering integral with the brace lath 31 make it possible to guide the template, by wedging it relative to the brace lath. Thus, each brace lath guides the user for the positioning of the template relative to the wooden boards of the cladding panel.

For example, the template comprises a second branch 11 that is substantially perpendicular to the first branch 12, the second branch 11 comprising the mechanism for rendering integral with the brace lath 31.

For example, the mechanism for rendering integral are formed from two stop elements 15, at least one of the stop elements 15 being configured to be movable in translation along a portion of the second branch 11. For example, each of the stop elements 15 is configured to be movable in translation along portions of the second branch 11. For example, each stop element 15 is a piece of rail that has a cross-section in the form of a "U" and is provided with at least one threaded rod 151 (which for example is welded on the stop 15), which rod is inserted in a longitudinal recess 111 provided in a portion of the second branch 11, and is then clamped by way of a nut 152 in order to secure the stop 15 in the correct position, i.e. abutting against the brace lath 31.

The threaded rod 151 can also be replaced by a hole provided in the corresponding stop 15, and a through-screw, which is also received in the longitudinal recess 111 provided in a portion of the second branch 11.

The stop element 15 can be displaced along a portion of the second branch 11, and can also be secured (by clamping of the threaded rod or the screw) in a given position of the second branch 11. For example, the stop elements 15 are secured on the second branch 11, such as to abut the brace lath 31.

Figure 2:
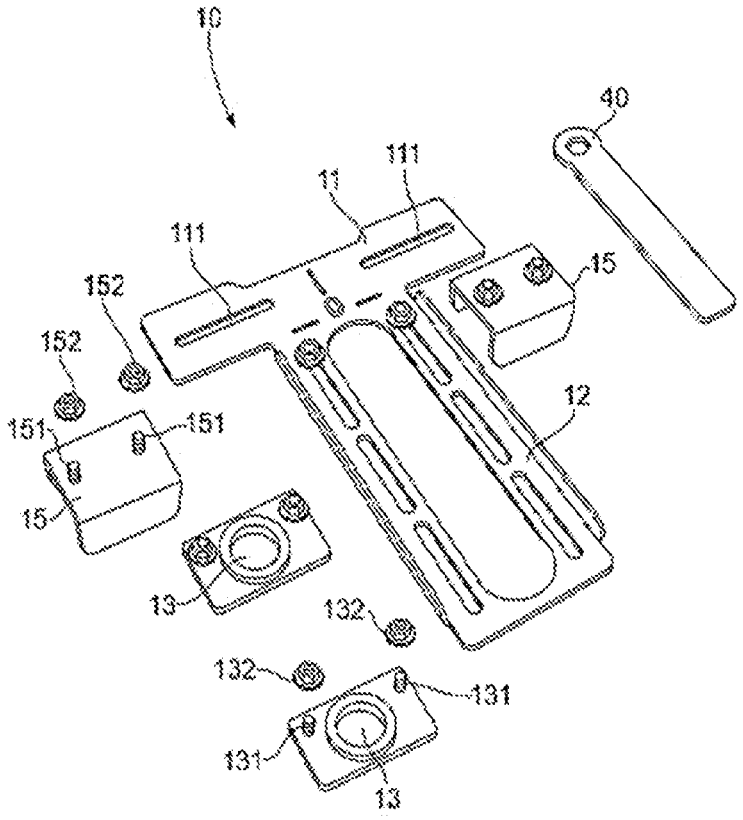
FIG. 2 is an exploded view of the template in FIG. 1.

The template 10 can be produced from a sheet of aluminum that is cut and bent in order to produce the parts illustrated in FIG. 2. FIG. 2 also illustrates a spanner 40 that can be produced during the step of cutting of the sheet of aluminum. The spanner 40, which can be supplied with the template, is used for example to tighten or untighten the screws making it possible to immobilize or render movable the stop elements 15 or the guide orifices 13.

Figure 3:
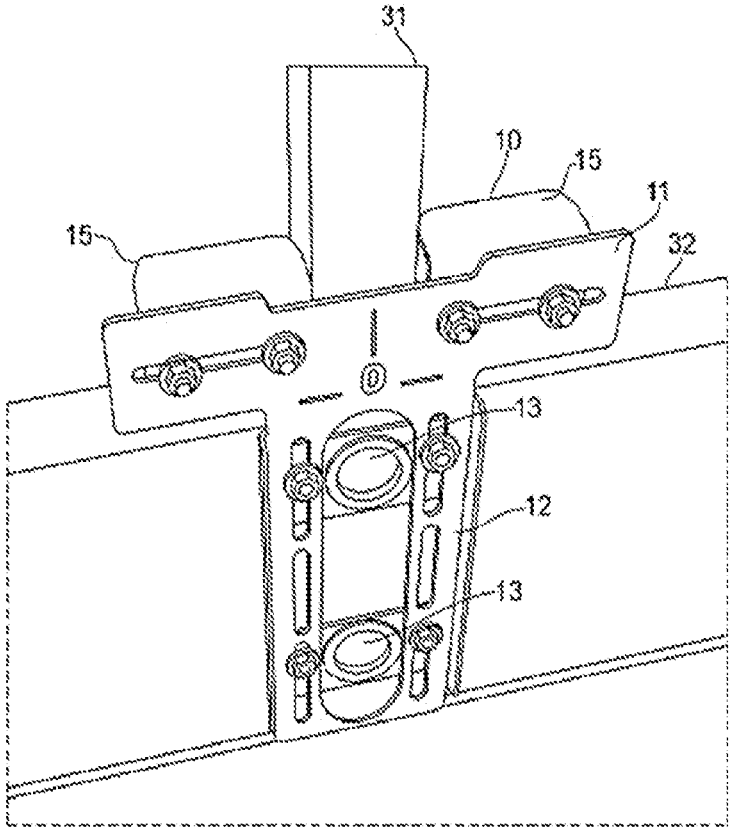
FIG. 3 is a view of the template in FIG. 1 in the situation of installing of a cladding board.

FIG. 3 shows the template 10 positioned on a brace lath 31 with its two guide orifices in position on the cladding board 32 (for example a wooden slat). The user, for example the installer of the cladding panel can then, for example thanks to a gas nail driver, drive a securing element, for example a nail, through each of the guide orifices 13. The use of a template of this type makes it possible to obtain alignment of the nails (for example horizontally and vertically) that is aesthetically pleasing and provides an attractive finish.

For example, the template 10 comprises at least one visual element enabling the user to identify a reference point 0, as well as adjustment dimensions of the template. Advantageously, these visual elements, for example the reference point 0 and the adjustment dimensions, are engraved on the template. This enables the user not to have to take measurements.

Figure 4:
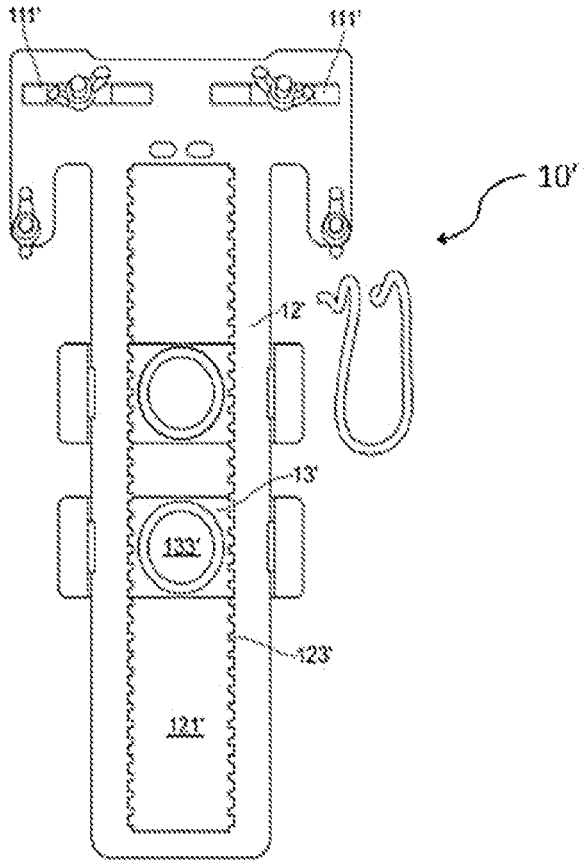
FIG. 4 is a view from the front of the template according to a second embodiment of the present disclosure.

According to a second embodiment of the present disclosure as illustrated in FIG. 4, the template 10' comprises a first branch 12' that is configured to be substantially aligned with a brace lath 31 on which an operator must secure a cladding board 32. For example, the first branch 12' comprises two guide orifices 13', at least some or all of these guide orifices 13' being configured to be movable in translation along the first branch 12'.

For example, the first branch 12' comprises a recess (or opening) 121' that is substantially aligned with the brace lath 31. The guide orifice 13' also comprises a recess 133'.

According to a characteristic of the present disclosure, at least some or all of the guide orifices 13' are removable.

The recess 121' of the first branch 12' and the recess 133' of the guide orifice 13' are also provided with at least two guide notches (123', 134') that are configured to cooperate with one another in order to permit the positioning of the guide orifice 13' on the template 10', such that the guide orifice 13' is situated facing the recess 121' of the template 10' when the notches are cooperating.

According to the second embodiment illustrated in FIG. 4, the notches 123' of the first branch 12' are situated in the interior of the recess 121', more specifically along the inner faces (124', 125') of the recess 121' (i.e. the faces parallel to the brace lath 31). It will be appreciated that it is within the capability of persons skilled in the art to arrange these notches in the best possible way such as to cooperate efficiently with the notches 134' of the guide orifice 13'.

The notches 134' for their part are situated on the rectangular body of the guide orifice 13'. For example, they are provided on the rectangular body, such as to correspond with the notches 123'. In FIG. 4, the notches are provided on two in the faces of two openings (136', 137') provided in the body of the guide orifice 13' and parallel to the inner faces (124', 125') of the recess 121'. It will be appreciated that other arrangements of the notches and forms are within the capability of persons skilled in the art, such as, for example, notches provided in openings provided in the body of the first branch, identical to the openings 122 in FIG. 1.

Figure 6:
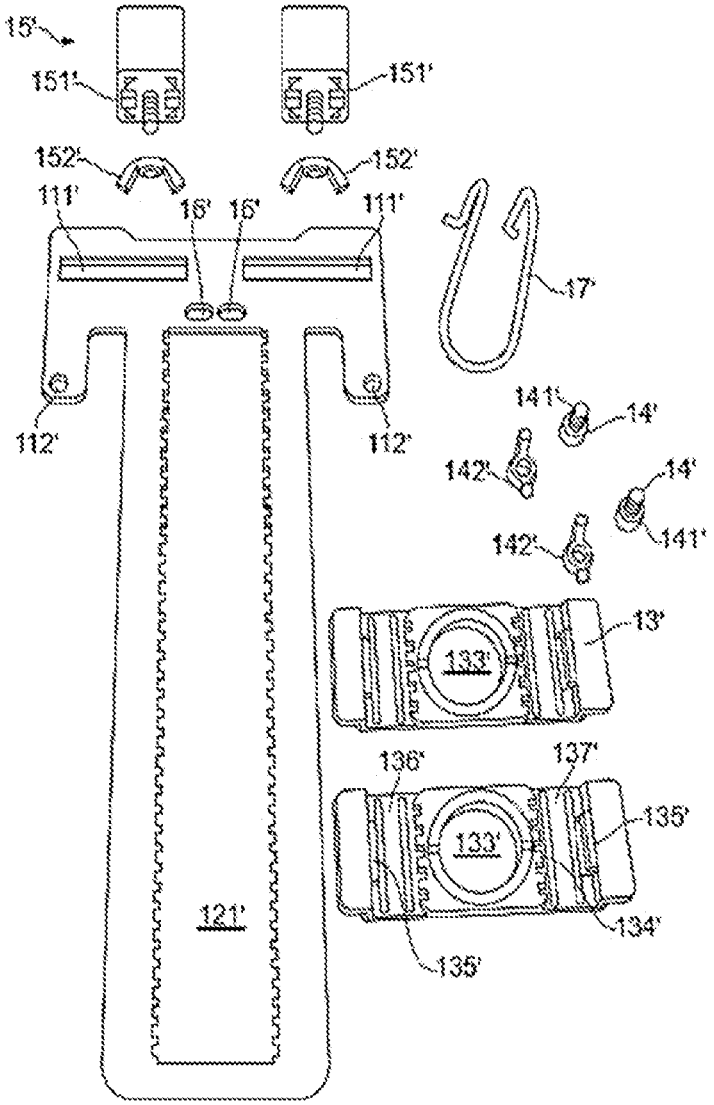
FIG. 6 is an exploded view of the template in FIG. 4.

In order to ensure retention of the guide orifice when the notches 123' and 134' are cooperating, two clip-on slats 135' make it possible to clip the guide orifice 13' onto the two branches 12' of the template 10'. These two clip-on slats are situated in the interior of the openings (136', 137') facing the notches 134', as illustrated in FIG. 6 of the exploded view.

The template also comprises a second branch 11' provided with a recess 111' making it possible to receive mechanisms for rendering integral with a brace lath 31, as already described in relation with the first embodiment in FIG. 1.

In the example in FIG. 4, the mechanism for rendering integral are formed by two stop elements 15', at least one of the stop elements 15' being configured to be movable in translation along a portion of the second branch 11'. For example, each of the stop elements 15' is configured to be movable in translation along a portion of the second branch 11'. For example each stop element 15' is a part, for example made of plastic with a square, round, hollow or solid form. When put into position, the stop 15' is in contact above the cladding board, while abutting against the brace lath.

It will be appreciated that, for handling of the cladding board 32 from below, the stop comes into contact with the underpart of the board.

As for the stop 15 of the first embodiment illustrated by FIG. 1, the stop 15' is provided with at least one threaded rod 151', which is inserted in the recess 111' provided in a portion of the second branch 11', and which is then clamped by a nut 152' in order to secure the stop 15' in the correct position, i.e. abutting against the brace lath 31.

The threaded rod 151' can also be replaced by a hole provided in the corresponding stop 15' and a through-screw, which screw is also received in the recess 111'. Thus, the stop element 15' can be displaced along a portion of the second branch 11' and can also be secured (by tightening of the nut 152' on the threaded rod or the screw) in a given position of the second branch 11'. For example, the stop elements 15' are secured on the second branch 11', such as to clamp the brace lath 31 against which they are fitted.

Figure 7:
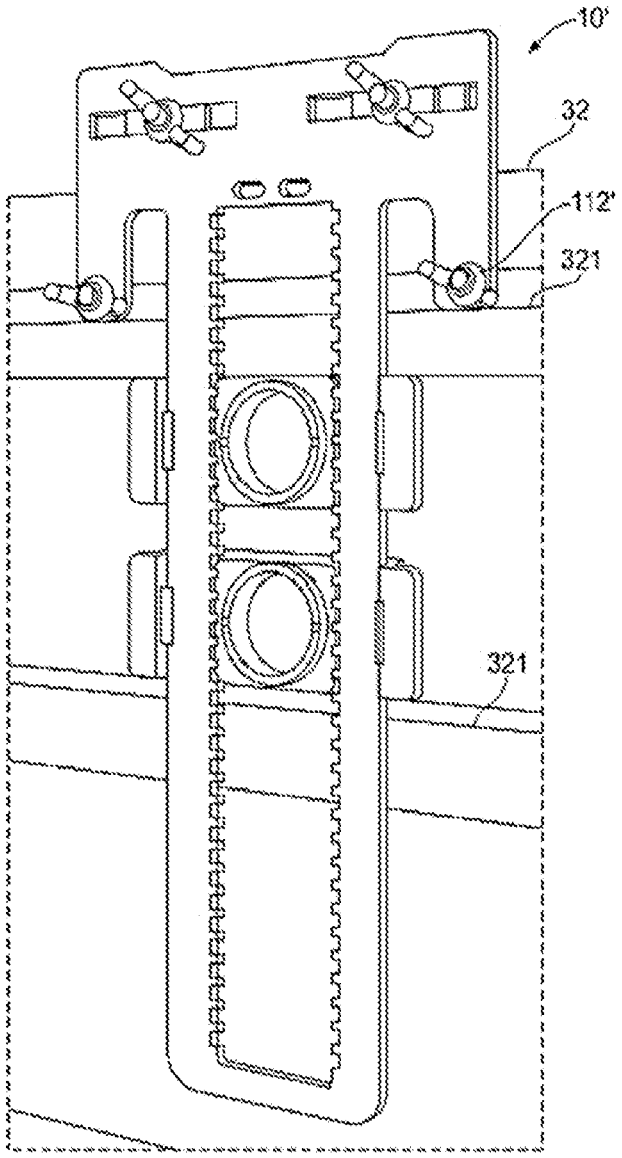
FIG. 7 is a view of the template in FIG. 4 when it is being put into place on a brace lath.

The second branch 11' also comprises mechanism 14' for alignment of the template 10', each mechanism 14' for alignment being configured to be supported on a rim of the cladding board as illustrated in FIG. 7. A rim of this type corresponds to the junction of two cladding boards 32.

Figure 5:
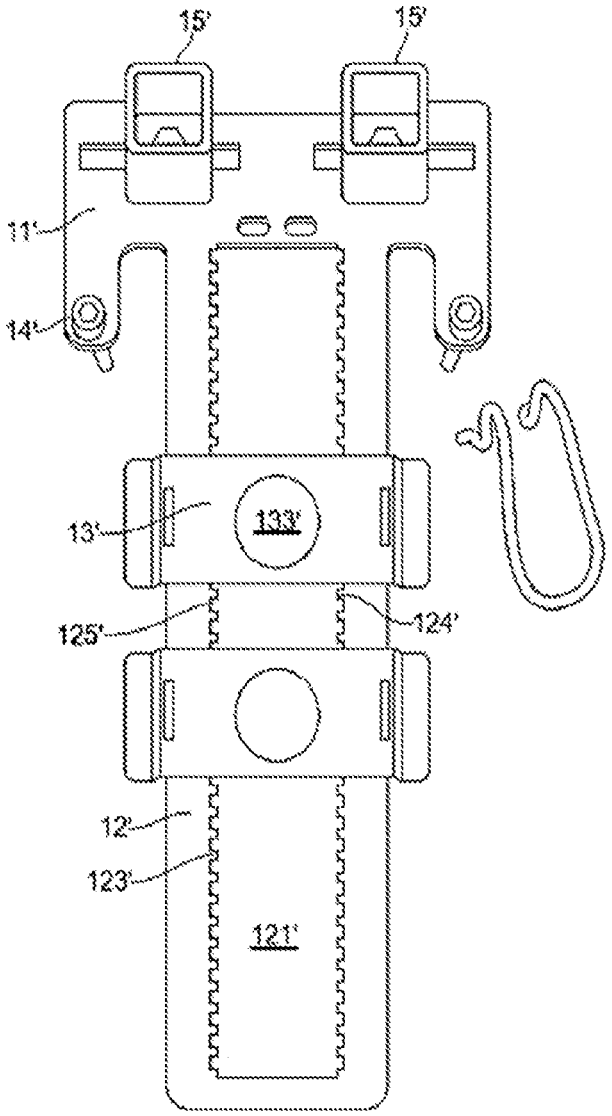
FIG. 5 is a view from the rear of the template according to the second embodiment of the present disclosure.

In FIG. 5, each mechanism 14' for alignment is provided in an orifice 112' of the second branch 11'. For example, each orifice 112' is placed at the end of the second branch 11'. For example, at least two mechanisms 14' for alignment are provided at each end of the second branch 11' (as in the template in FIG. 4).

The mechanism 14' for alignment is for example formed by a screw 141' passing through the corresponding orifice 112' and a nut 142' making it possible to tighten the screw 141', with the screw head of the screw 141' acting as a guide when it is supported on the edge of the cladding board as illustrated in FIG. 7. Thus, in addition to the stop elements 15' that make it possible to render the template 10' integral and align it, the mechanisms 14' for alignment also make it possible to guide the operator. Advantageously, only these mechanism 14' for alignment are used by the operator for the operation of securing of the cladding boards 32.

According to a variant of the present disclosure, the screw head of the screw 141' is surrounded by a plastic material with variable hardness. A stop of this type is then of the damping (or bumper) type.

Figure 8:
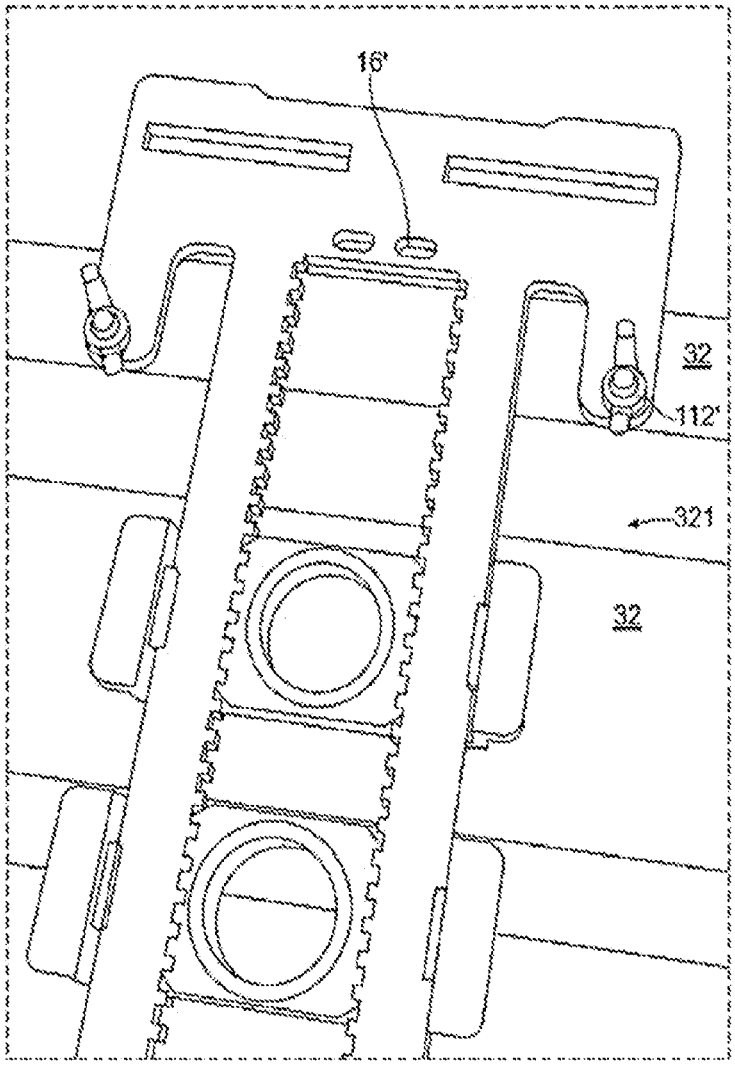
FIG. 8 is a view of the template in FIG. 4 when the brace lath is not accessible by the template, typically when the objective is to secure a final cladding board on the brace lath.

For example, at least one damper of this type is removable. By simple rotation movement of the hand so as to dislodge the damper from the screw head acting as a core, it is then easy for the operator to change the type of damper (thickness, width) according to the thickness of the rim 321 corresponding to the junction of two cladding boards 32. A configuration of this type is represented in FIG. 8. It should be noted that these additional mechanism 14' for alignment are particularly advantageous when the operator no longer has access to the brace lath, as is the case when the operator reaches the final board to be secured, as illustrated in FIG. 8 (in this case, the mechanisms for rendering integral are not present, and it is difficult for the operator to guide the template 10' along the brace lath 31).

For example, the mechanism 14' for alignment of the template 10' are fixed or movable relative to the second branch 11'. In the example illustrated in FIG. 7, they are fixed, but they can also be movable.

According to one embodiment of the present disclosure, the template can be made of wood or a composite material, or also agglomerates such as MDF (Medium Density Fibreboard) material.

Figure 9:
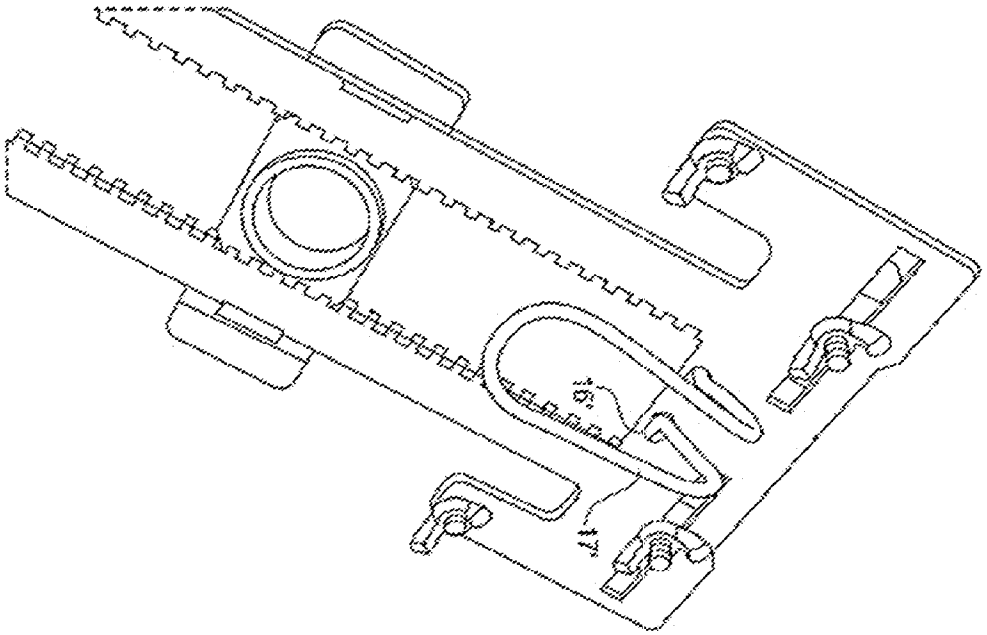
FIG. 9 is a view of the template in FIG. 4 illustrating mechanisms for retention of the template.

The template 10' also comprises mechanisms for securing, for example at least one orifice 16' as illustrated in FIG. 9, and for making it possible to receive a securing element 17, for example a hook, for retention of the template on a belt (not represented) for example.

Figure 10:
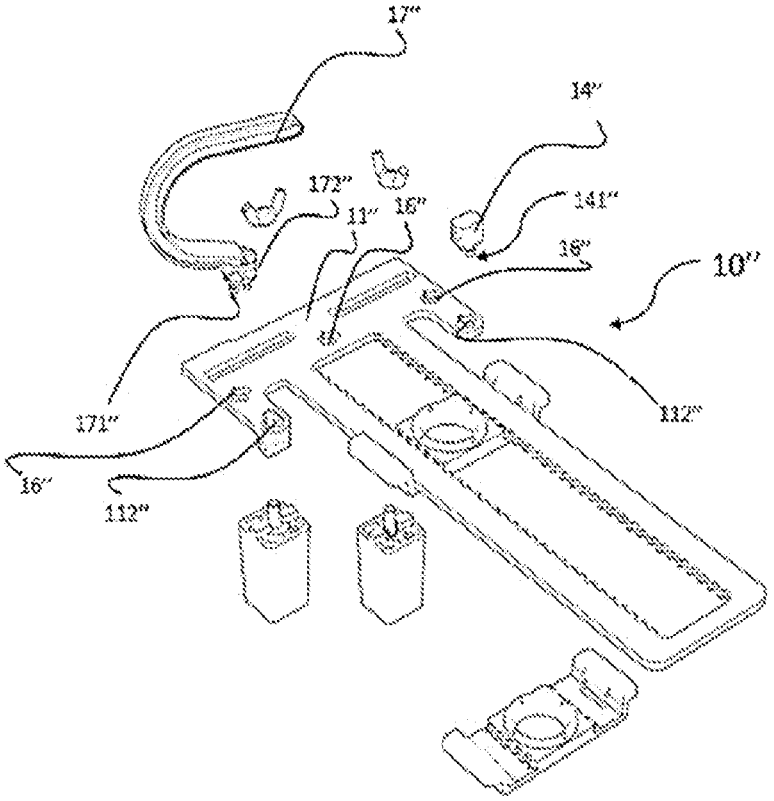
FIG. 10 illustrates a third embodiment of the template according to the present disclosure, in an exploded view.
Figure 11:
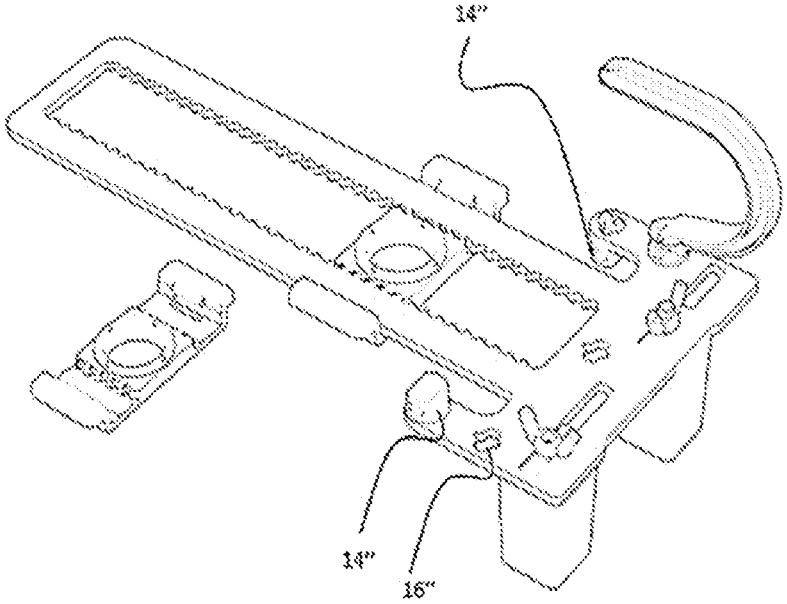
FIG. 11 illustrates a preferred embodiment of the template according to the present disclosure, in an assembled view.
Figure 12:
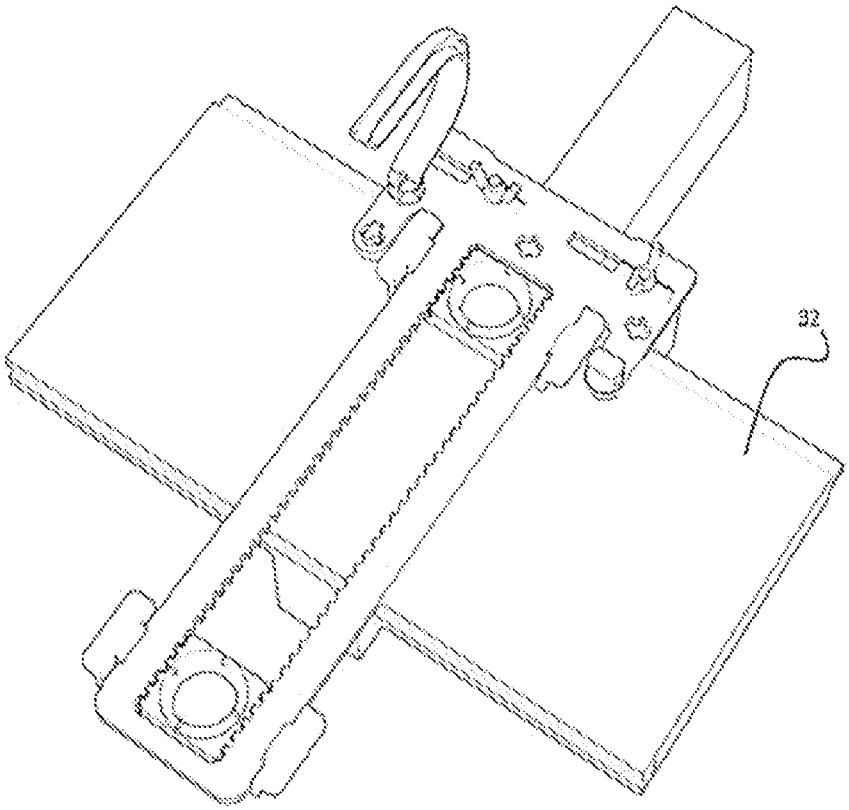
FIG. 12 illustrates the third embodiment of the template according to the present disclosure, in position on a cladding board.

A template according to a third embodiment of the present disclosure is now illustrated in FIGS. 10 to 12.

For the sake of clarity, substantially elements that are new or modified are referenced therein.

The common elements that have previously been described in relation with the first embodiment and the second embodiment will not be described or incorporated again in FIGS. 10 to 12.

According to this third embodiment, a securing element 17", for example of the hook type as previously described in relation with the securing element 17', comprises at its end 172" a mechanism 171" for rendering integral, which can be inserted in an orifice 16" provided in the second branch 11". The second branch 11" is in this case identical to the second branch 11 or 11' of the preceding embodiments.

The function of the securing element 17" is also identical to the function of the securing element 17' in FIGS. 5 to 9, i.e. to enable the user to secure the template on a belt, for example.

Preferably, the mechanism 171" for rendering integral is a securing clip that is configured to be inserted in the corresponding orifice 16".

According to a particular embodiment, the orifice 16" comprises an area of insertion with a form that cooperates with that of the mechanisms 171" for rendering integral. Once inserted in the orifice 16", rotation of the securing element 17"' makes it possible to block the mechanism 171" for rendering integral of the clip type against the second branch.

For example, according to FIG. 10, three orifices 16" are provided in the second branch 11". This makes it possible in particular for the user to have available at least one position enabling him to position the securing element 17" on the second branch.

Also, in this third embodiment, mechanism 14" for alignment are provided, the function of which is identical to the function of the mechanisms 14' for alignment in FIGS. 4 to 9. Only the form and the structure differ. For example, the mechanism 14" for alignment are in the form of a lug, which for example is made of plastic. At the end of each mechanism for alignment, a mechanism 141" for rendering integral with an identical form is provided, preferably with the mechanism 171" for rendering integral. The system for securing of the mechanisms for rendering integral is also identical to the system for securing of the clip type of the mechanisms 171" for rendering integral.

In order to carry out the alignment of the template 10", orifices 112", the function of which is identical to that of the orifices 112' of the second embodiment, are provided on the second branch 11". Each orifice 112" is configured to receive the mechanism 141" for rendering integral. The form of each orifice 112" is preferably identical to the form of the orifices 16", the mechanism 14" for alignment also being blocked by rotation of the mechanisms for alignment in the orifice 112' in order to carry out blocking thereof against the second branch.

According to the situation, the user thus has the possibility of adding or removing the securing element 17" and the mechanisms 14" for alignment, easily and without tools.

It will be appreciated that the orifices 16' or 16", 112' or 112" can also be provided on the template in FIG. 10 corresponding to the first embodiment.

Persons skilled in the art will appreciate that a plurality of variants of the aforementioned embodiments can be envisaged without departing from the context of the present disclosure.

Throughout the description and the claims of this specification, the words "comprise" and "contain" and their variations mean "including but not limited to", and they are not destined for (and do not exclude) other parts, additives, components, whole units or steps. Throughout the description and the claims of this specification, the singular incorporates the plural, unless the context requires otherwise. In particular, when the indefinite article is used, the specification must be understood as envisaging the plural as well as the singular, unless the context requires otherwise.

The characteristics, whole numbers, features, components or units described in association with one aspect, one embodiment or one particular example of the present disclosure must be understood as being applicable to any other aspect, embodiment or example described in the present document, unless there is incompatibility therewith. All the characteristics disclosed in the present specification (including the claims, the abstract and the accompanying drawings), and/or all the steps of a method or a process thus disclosed, can be combined according to any combination, with the exception of the combinations where at least some of these characteristics and/or steps are mutually exclusive. The present disclosure is not limited to the details of all the preceding embodiments. The present disclosure extends to any new characteristic, or new combination, of the characteristics disclosed in the present specification (including the claims, the abstract and the accompanying drawings), or to any new characteristic, or new combination, of the steps of any procedure or process thus disclosed.

The attention of the reader is drawn to all the papers and documents that have been filed simultaneously with, or prior to, this specification in relation with this application, and that are open to public inspection with this specification, and the content of all these papers and documents is incorporated here by reference.

LIST OF THE REFERENCE SIGNS

10, 10', 10" template
11, 11', 11" second branch
111, 111' longitudinal recess
112', 112" orifice
12, 12' first branch
121, 121' recess
122 opening
123' guide notches
124' inner face
125' inner face
13, 13' guide orifice
131 screwing head
132 nut
133, 133' recess
134' guide notch
135' clip-on slat
136' opening
137' opening
14', 14" mechanisms for alignment
141' screw
141" mechanism for rendering integral
142' nut
15, 15' stop
151, 151' threaded rod
152, 152' nut
16', 16" orifice
17', 17" securing element
171" mechanism for rendering integral
172" end
31 brace lath
32 cladding board
321 rim
40 spanner

The invention claimed is:

1. A template for guiding securement of a cladding board on a brace lath, said template comprising:

a first branch configured to be substantially aligned with the brace lath;

a first guide orifice connected to the first branch and configured to guide a first securing element in a first position to secure the cladding board on the brace lath, wherein the first guide orifice is movable relative to the first branch;

a second guide orifice connected to the first branch and configured to guide a second securing element in a second position to additionally secure the cladding board on the brace lath, the second position spaced-apart from the first position;

a second branch connected to the first branch and extending substantially perpendicular to the first branch; and two stop elements connected to the second branch and positionable against the brace lath.

2. The template of claim 1, wherein the second guide orifice is movable relative to the first branch.

3. The template of claim 1, wherein the first guide orifice is movable in translation along the first branch.

4. The template of claim 1, wherein the first branch and the first guide orifice each comprise part of a translation mechanism that enables the translation of the first guide orifice along the first branch.

5. The template of claim 1, wherein at least one of the stop elements is movable in translation along a portion of the second branch.

6. The template of claim 5, wherein both of the stop elements are movable in translation along respective portions of the second branch such that the stop elements are respectively positionable to press against opposite sides of the brace lath.

7. The template of claim 1, wherein the first branch comprises a fastener and the first guide orifice defines a hole configured to receive the fastener to secure the first guide orifice to the first branch.

8. The template of claim 1, wherein the second branch defines a longitudinal recess.

9. The template of claim 8, wherein one of the two stop elements includes a threaded rod.

10. The template of claim 9, wherein the longitudinal recess is configured to receive the threaded rod to secure one of the two stop elements to the second branch.

11. The template of claim 8, wherein one of the two stop elements defines a hole.

12. The template of claim 11, wherein the hole and the longitudinal recess are each configured to receive a through screw to secure one of the two stop elements to the second branch.

13. The template of claim 1, wherein the two stop elements each have a cross section in the form of a "U".

14. The template of claim 1, wherein the template is made of aluminum.

15. The template of claim 1, wherein the first guide orifice defines a vertical recess.

16. The template of claim 15, wherein the first guide orifice comprises two screwing heads and wherein the two screwing heads are positioned adjacent to the vertical recess.

* * * * *